US007862665B2

(12) United States Patent
Hedstrom et al.

(10) Patent No.: US 7,862,665 B2
(45) Date of Patent: Jan. 4, 2011

(54) PUMP SYSTEM FOR A DRAWER-TYPE DISHWASHER

(75) Inventors: Kristen K. Hedstrom, Orlando, FL (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 1595 days.

(21) Appl. No.: 11/053,137

(22) Filed: Feb. 9, 2005

(65) Prior Publication Data

US 2006/0174918 A1 Aug. 10, 2006

(51) Int. Cl.

| | |
|---|---|
| ***A47L 15/46*** | (2006.01) |
| ***B08B 3/00*** | (2006.01) |
| ***B08B 9/20*** | (2006.01) |
| ***B08B 7/04*** | (2006.01) |

(52) U.S. Cl. ..... 134/58 D; 134/25.2; 134/18; 134/56 D

(58) Field of Classification Search ..... 134/115 G, 134/186, 184, 56 R–58 DL, 18, 25.2, 57 D, 134/58 D See application file for complete search history.

(56) References Cited

U.S. PATENT DOCUMENTS

| | | | | |
|---|---|---|---|---|
| 3,288,154 | A | 11/1966 | Jacobs | |
| 4,150,679 | A * | 4/1979 | Cushing et al. | 134/104.1 |
| 4,201,345 | A * | 5/1980 | Ziegler | 241/46.012 |
| 4,319,599 | A * | 3/1982 | Dingler et al. | 134/104.4 |
| 4,809,524 | A * | 3/1989 | Sickert et al. | 68/148 |
| 5,016,667 | A | 5/1991 | Tolf | |
| 5,320,120 | A * | 6/1994 | Hoffman et al. | 134/104.1 |
| 5,450,868 | A * | 9/1995 | Young, Jr. | 134/111 |
| 5,470,142 | A | 11/1995 | Sargeant et al. | |
| 5,499,640 | A * | 3/1996 | Kirkland | 134/56 D |
| 5,651,380 | A | 7/1997 | Sargeant et al. | |
| 5,651,382 | A | 7/1997 | Sargeant et al. | |
| 5,700,329 | A * | 12/1997 | Edwards et al. | 134/10 |
| 5,709,237 | A | 1/1998 | Sargeant et al. | |
| 5,743,281 | A | 4/1998 | Sargeant et al. | |
| 5,755,244 | A | 5/1998 | Sargeant et al. | |
| D400,320 | S | 10/1998 | Brace | |
| 6,189,551 | B1 * | 2/2001 | Sargeant et al. | 134/200 |

(Continued)

FOREIGN PATENT DOCUMENTS

| | | |
|---|---|---|
| DE | 3337369 | 4/1985 |

(Continued)

*Primary Examiner*—Michael Kornakov
*Assistant Examiner*—Stephen Ko
(74) *Attorney, Agent, or Firm*—Robert A. Bacon; Diederiks & Whitelaw PLC

(57) ABSTRACT

A drawer-type dishwasher includes a frame assembly, a tub, a wash arm and a pump system. The pump system includes a flow housing mounted at a rear portion of the tub and a drain conduit. The flow housing includes an inlet portion, an outlet portion, a pump portion and a drain port. Within the pump portion are arranged an impeller, a chopper mechanism as well as a plurality of flow straightening fins. A motor is mounted to the flow housing for driving the impeller and the chopper mechanism. The drain conduit is connected between the drain port and a drain line. A venturi is provided in the drain conduit to create a siphoning action the decreases an amount of time required to drain the tub.

29 Claims, 5 Drawing Sheets

U.S. PATENT DOCUMENTS

| | | | | |
|---|---|---|---|---|
| 6,244,277 | B1 | 6/2001 | Maunsell | |
| 6,260,565 | B1 | 7/2001 | Welch et al. | |
| 6,294,767 | B1 | 9/2001 | Sargeant et al. | |
| 6,571,808 | B2 | 6/2003 | Todd | |
| 6,811,617 | B2 * | 11/2004 | Elick et al. | 134/10 |
| 2004/0085006 | A1 * | 5/2004 | Shinchi et al. | 312/228 |

FOREIGN PATENT DOCUMENTS

| | | |
|---|---|---|
| JP | 2000350693 | * 12/2000 |
| JP | 2003-310518 | * 11/2003 |
| JP | 2004-129772 | * 4/2004 |
| WO | 93/12706 | 7/1993 |

* cited by examiner

PUMP SYSTEM FOR A DRAWER-TYPE DISHWASHER

BACKGROUND OF THE INVENTION

1. Field of the Invention

The present invention pertains to the art of dishwashers and, more particularly, to a pump system for a drawer type dishwasher.

2. Discussion of the Prior Art

In general, drawer-type dishwashers are known in the art. Typically, a drawer-type dishwasher will include a drawer or pull-out wash tub slidably mounted in a cabinet. A dish rack is provided within the wash tub to support dishware and the like during a washing operation. In some cases, the dishwasher will include first and second drawers or wash tubs arranged in an upper and lower configuration. However, regardless of the particular configuration, drawer-type dishwashers generally fall into two groups. In the first group, major wash system components, i.e., motors (wash and/or drain), heating elements, and filters are fixedly mounted relative to the cabinet. The drawer is provided with structure that is adapted to engage into corresponding structure in the cabinet so as to both fluidly and electrically interconnect the drawer with the major wash system components. In the second group, the major wash system components are mounted directly to the drawer.

When designing a dishwasher that falls into the second group, space, particularly vertical height, is a critical concern. In models that employ upper and lower wash tubs, conserving vertical height is of greater concern. Toward that end, manufacturers have developed a variety of designs directed to maximizing an overall vertical height of the wash tub. In one configuration, a single motor is mounted below the wash tub and is used to drive both a wash pump and a drain pump. In other configurations, the wash pump is actually an integral part of another, separate wash system component, for example, a wash arm.

In any event, in order maximize the vertical height of the wash tub, the overall number of major wash system components is typically reduced, along with the number of fluid conduits or passages that circulate the washing fluid throughout the tub. Regardless of the particular arrangement, the reduction in wash system components and fluid conduits, while achieving a desired decrease in vertical height, can limit the overall functionality of the dishwasher. That is, certain system components, such as heaters, filters and chopping blades typically found in larger units, cannot always be accommodated in more compact arrangements.

Based on the above, there exists a need in the art for a drawer-type dishwasher having all of the major wash system components typically found in larger, conventional dishwashers without subtracting from an overall vertical height of the wash tub. More specifically, there exists a need for a drawer-type dishwasher having compact pump system that is mounted to the tub in such a fashion as to not subtract from the overall vertical height of the tub while, at the same time, effectively allowing room for other wash system components.

SUMMARY OF THE INVENTION

The present invention is directed to a dishwasher including a frame and a drawer or tub slidably mounted within the frame. The tub includes front, rear, bottom and opposing side walls that collectively define a wash chamber. A lid is positioned above the tub to selectively close the washing chamber during a washing operation. In addition, the wash chamber is provided with at least one wash arm that is arranged so as to spray or direct jets of washing fluid onto dishware to dislodge or remove food particles. The flow of washing fluid is established by a pump system that is preferably mounted at a rear portion of the tub.

In accordance with the invention, the pump system includes a flow housing and a drain conduit. The flow housing, mounted at the rear of the tub, includes an inlet portion, an outlet portion, a pump portion and a drain port. The pump portion includes an impeller, a chopping mechanism and a plurality of flow straightening fins. A motor is mounted to the flow housing for driving the impeller and the chopping mechanism. During a washing operation, the motor is activated, driving the impeller to establish a flow of washing fluid. Washing fluid flows from the wash chamber into the inlet portion and is thereafter expelled from the outlet portion, passed through one or more filters, and re-introduced back into the wash chamber. In accordance with the preferred embodiment of the invention, the flow housing extends substantially horizontally and laterally across the rear portion of the tub.

Periodically during the washing operation, as well as upon completion thereof, the washing fluid is drained from the wash chamber. When a drain operation is indicated, a solenoid is activated to open a drain valve. The drain valve is preferably arranged at the drain port of the flow housing. Once opened, the pump portion directs the washing fluid through the drain port into the drain conduit. In accordance with the invention, the drain conduit is generally U-shaped and includes a first section connected to the drain port, a central section and an outlet section that leads to a main drain.

In accordance with the most preferred embodiment of the invention, the drain conduit is provided with a venturi that creates a siphoning action to shorten the overall time needed to perform the drain operation. Preferably, the venturi is arranged in the central section of the drain conduit. Toward that end, the central section of the drain conduit includes a first portion having a first cross-sectional area, a second portion having a second cross sectional area, and a third portion having a third cross-sectional area. In accordance with the most preferred embodiment of the invention, the second cross-sectional area is smaller than either the first or the third cross-sectional areas such that a flow restricting venturi is established in the second portion.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
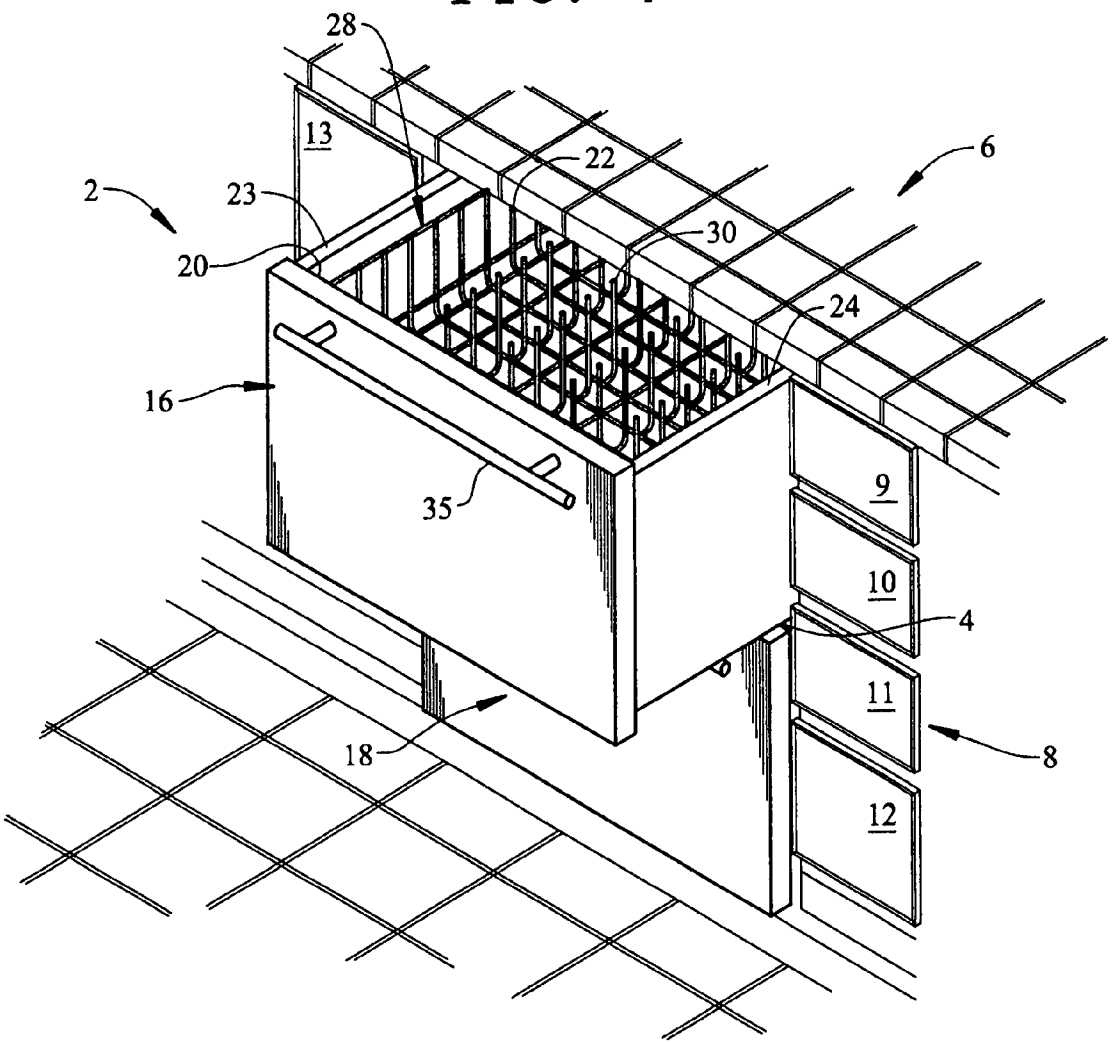
FIG. 1 is an upper right perspective view of a drawer-type dishwasher incorporating a pump system constructed in accordance with the present invention.
Figure 2:
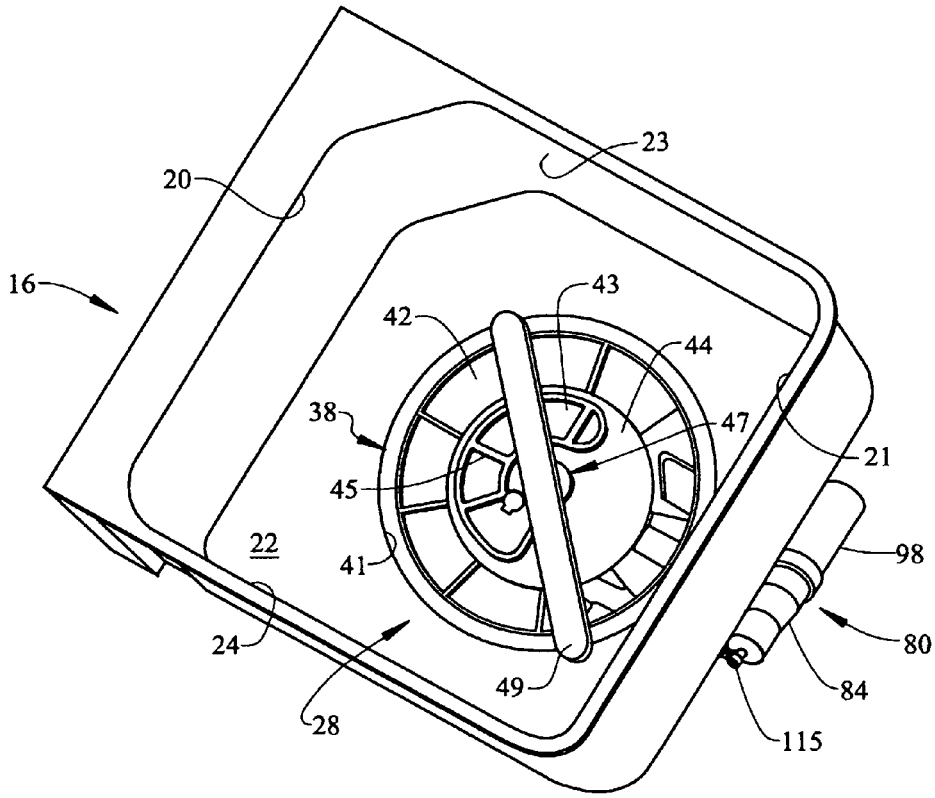
FIG. 2 is an upper perspective view of a wash chamber employed in the dishwasher of FIG. 1.
Figure 3:
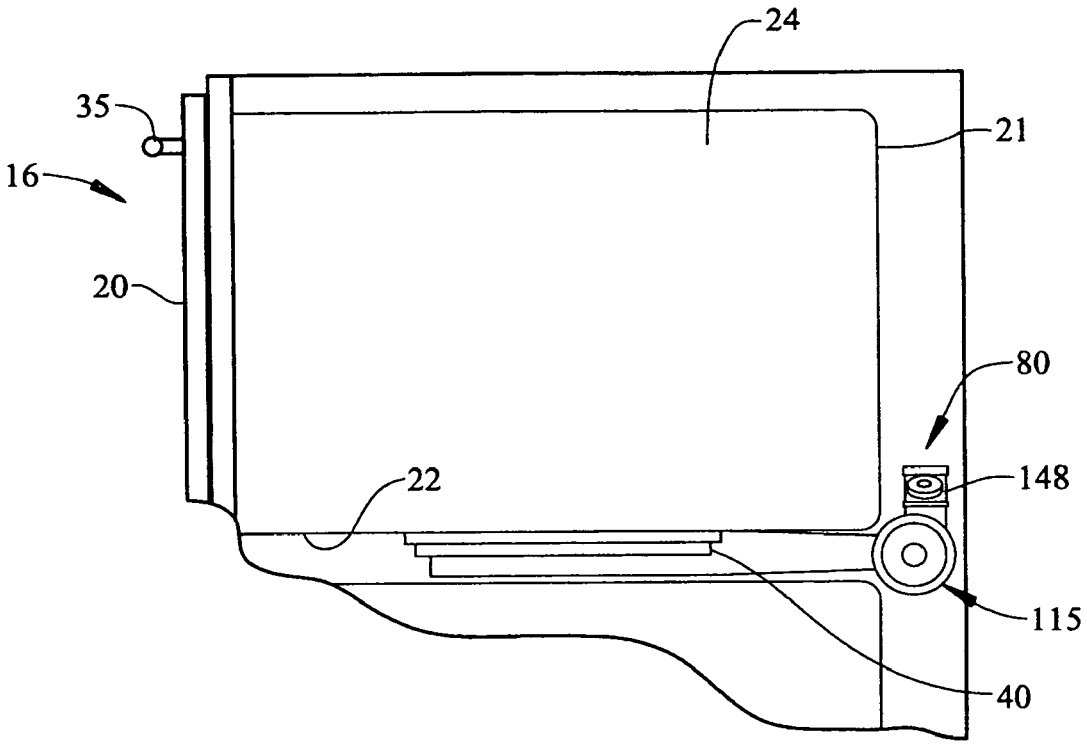
FIG. 3 is a partial, cross-sectional side view of the dishwasher of FIG. 1 illustrating the location of the pump system of the present invention.

With initial reference to FIGS. 1-3, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with a drawer-type dishwasher 2 depicted as a dual cavity dishwasher having an upper washing unit 16 and a lower washing unit 18.

Both upper washing unit 16 and lower washing unit 18 preferably take the form of slide-out tubs or drawer units. Each washing unit 16 and 18 is capable of independent operation such that a consumer may operate one, the other, or both washing units 16 and 18 depending upon a particular need. Of course, it should be understood that dishwasher 2 could take on various forms such as, for example, combination drawer/conventional washing chambers or simply a single drawer unit. In any event, as each washing unit or drawer 16, 18 is identical, a detailed description will be made with respect to drawer 16 with an understanding that drawer 18 has corresponding structure.

In accordance with a preferred form of the invention, drawer 16 includes a front wall 20, a rear wall 21, a bottom wall 22 and opposing side walls 23 and 24 that collectively define a wash chamber 28. In a manner known in the art, wash chamber 28 is provided with a dish rack 30 for supporting various objects, such as dishware, glassware, and the like, that are exposed to a washing operation. In a manner also known in the art, drawer 16 is slidingly supported within support frame 4 through a pair of extensible glide rails (not shown). In addition, drawer 16 is provided with a handle 35 to enable a consumer to grasp and shift drawer 16 relative to frame 4.

Figure 4:
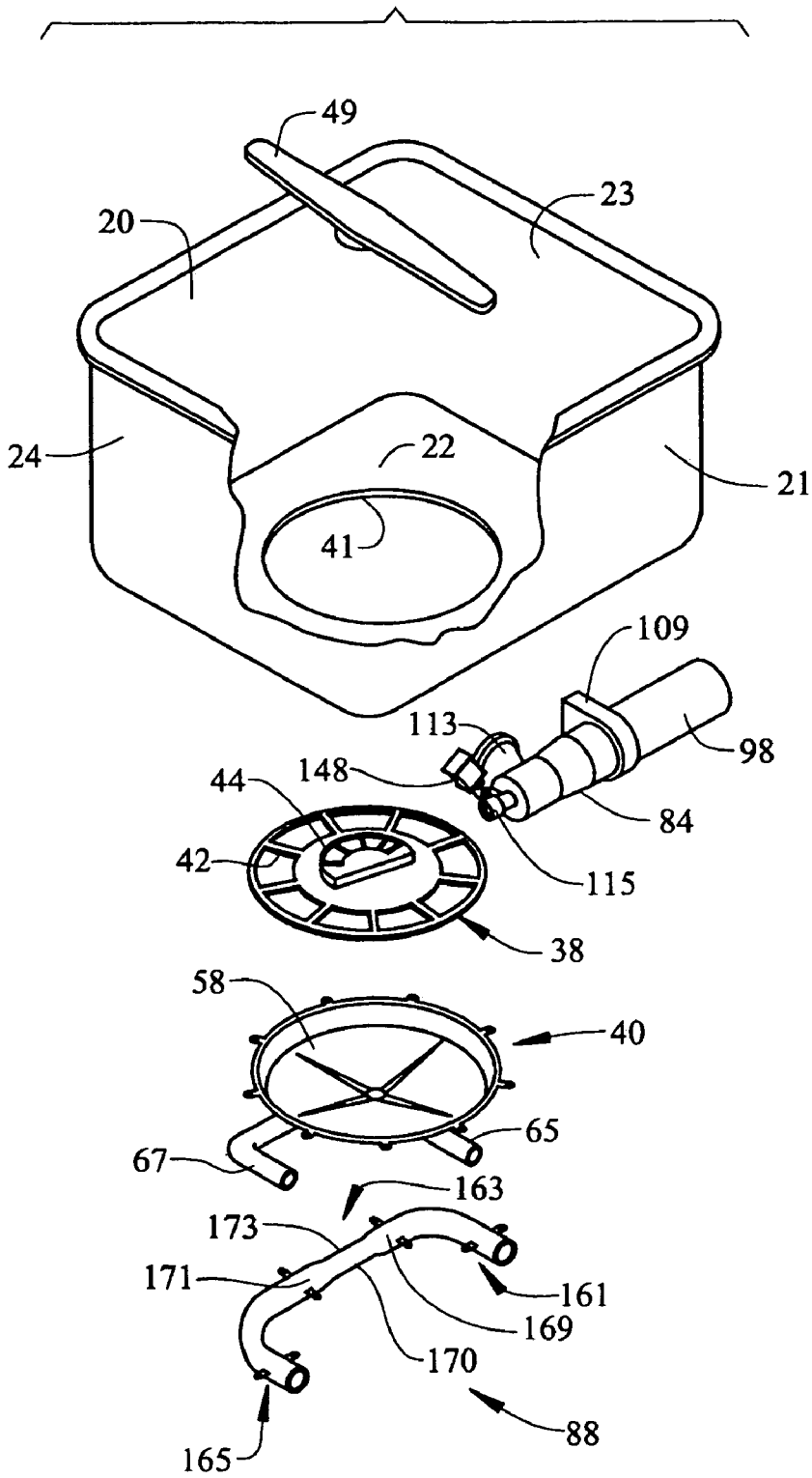
FIG. 4 is an exploded view of the wash chamber and pump system of the invention.

As best shown in FIGS. 2 and 4, a main filter portion 38 is provided on bottom wall 22 within wash chamber 28. Main filter portion 38 is actually positioned above a sump portion 40 that is mounted across an opening 41 in bottom wall 22. In any event, main filter housing 38 includes a coarse or first radial strainer 42, a fine or second radial strainer 43 and a cover 44. Actually, second radial strainer 43 is part of a fine particle filter chamber (not shown) that includes a fine mesh filter screen (not separately labeled) provided within each of a plurality of large radial spaced openings 45 arranged about cover 44. A hub member 47 extends through cover 44 and serves as a support and a fluid conduit for a wash arm 49.

As will be discussed more fully below, a flow of washing fluid is supplied from sump portion 40, up through hub member 47 to wash arm 49 and thereafter directed onto kitchenware placed within wash chamber 28. The washing fluid then flows over a flow plate 58 to return to sump portion 40 to be recirculated back to wash arm 49, while a portion flows into the fine particle filter chamber below second radial strainer 43. Toward that end, sump portion 40 is provided with an inlet conduit 65 that leads to wash arm 49 and a recirculation conduit 67 that leads from wash chamber 28. In general, the structure described above with respect to dishwasher 2 does not constitute aspects of the present invention but has only been described for the sake of completeness. Instead, the present invention is particularly directed to a pump system 80 that is fluidly connected to sump portion 40 for establishing the flow of washing fluid, as well as performing periodic drain operations as will be detailed fully below. As best shown in FIGS. 3 and 4, pump system 80 includes a flow housing 84 that is mounted at a rear portion of wash chamber 28. Preferably, flow housing 84 is mounted substantially horizontally adjacent rear wall 21 of wash chamber 28. Most preferably, flow housing 84 extends laterally across rear wall 21. In any event, pump system 80 also includes a drain conduit 88 (FIG. 4) for directing washing fluid from wash chamber 28 to a drain (not shown) as will be detailed more fully below.

Figure 5:
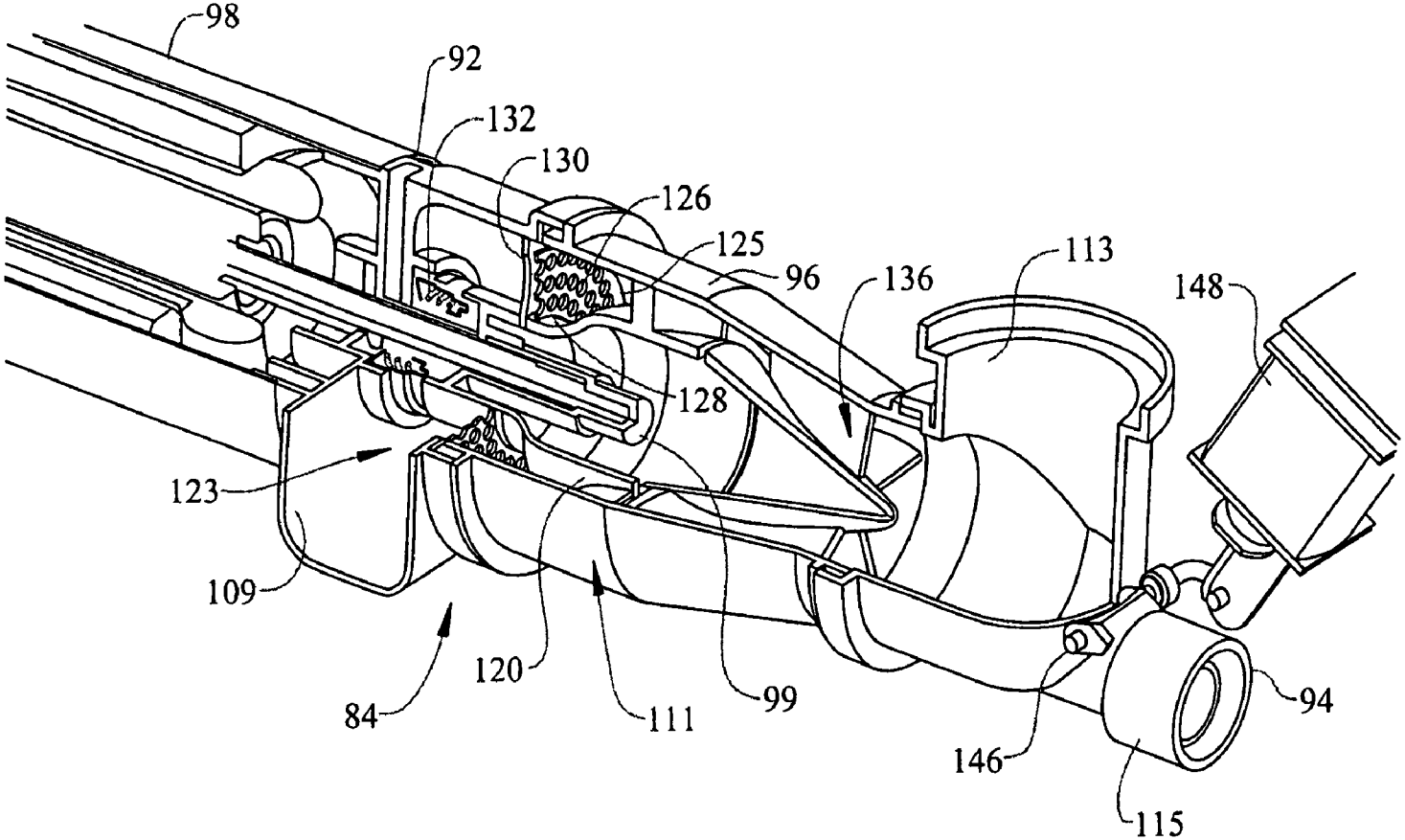
FIG. 5 is a partial, cut-away view of a flow housing portion of the pump system constructed in accordance with the present invention.

With particular reference to FIG. 5 showing a preferred embodiment of the invention, flow housing 84 includes a first end 92 that leads to a second end 94 through an intermediate section 96. A motor 98 having a drive member 99 is mounted to first end 92 such that drive member 99 extends into intermediate section 96. Flow housing 84 includes an inlet portion 109 which is open to sump portion 40 and arranged adjacent to first end 92, a pump portion 111 arranged within intermediate section 96, an outlet portion 113 arranged downstream of pump portion 111, and a drain port 115 which is adapted to connect with drain conduit 88 and positioned downstream of outlet portion 113.

In further accordance with the preferred embodiment of the present invention, pump portion 111 establishes a flow of washing fluid that is guided from inlet portion 109 to outlet portion 113 and ultimately to wash arm 49. Toward that end, arranged within pump portion 111 is an impeller 120 that is drivenly connected to drive member 99. Also provided in pump portion 111 is a chopping mechanism 123. Chopping mechanism 123 is employed to macerate food particles entrained within the washing fluid. As shown, chopping mechanism 123 includes an apertured plate 125 that is provided with a plurality a small radial openings 126 and a central opening 128. A chopper blade 130 is rotated relative to and closely adjacent apertured plate 125 by drive member 99. In order to prevent chopper blade 130 from becoming jammed or damaged in the event of contact with a large or hard food particle, a spring element 132 is operatively connected to chopper blade 130. That is, in the event chopper blade 130 comes in contact with a hard or large soil particle, spring element 132 enables chopper blade 130 to shift away from apertured plate 125 to continue rotating with drive member 99. Over time, repeated impacts of chopper blade 130 on the hard soil particle will macerate or break-up the particle and enable normal operation.

In order to ensure efficient operation of pump system 80, pump portion 111 also includes a plurality of flow straightening fins which are indicated generally at 136 and mounted within intermediate section 96. Straightening fins 136 function to reduce a turbulence of the wash flow imparted by impeller 120. More specifically, washing fluid in wash chamber 28 flows into sump portion 40 over flow plate 58 and enters inlet portion 109 of flow housing 84. The flow of washing fluid travels past chopping mechanism 123 under the force of impeller 120 toward outlet portion 113. The rotation of impeller 120 creates a turbulence in the wash flow, which is then directed past flow straightening fins 136 to outlet portion 113 and wash arm 49. Without flow straightening fin 136, the turbulence generated by impeller 120 could negatively impact the efficiency of the washing operation. Although not part of the present invention, a portion of the washing fluid is preferably diverted, prior to wash arm 49, into the fine particle collection chamber (not shown) below fine strainer 43. Of course, it should be understood that additional wash arms could be provided in wash chamber 28. In any event, this recirculating flow of washing fluid, over time, results in 100% filtration removing substantially all soil particles and the like entrained within the washing fluid so as to ensure efficient operation.

Periodically during the washing operation, the washing fluid must be purged or drained from wash chamber 28 to allow the introduction of clean rinse fluid or, at the termination of the overall washing operation, to allow the removal of dishware. When a drain operation is indicated, a valve 146, arranged upstream of drain port 115, is opened to allow the washing fluid to enter drain conduit 88. As shown, valve 146 is connected to a solenoid 148 which, when activated, rotates valve 146 to the open position. Thus, valve 146 is constituted by a one-way or flapper valve that prevents washing fluid expelled into drain conduit 88 from returning into flow housing 84. As will be discussed fully below, drain conduit 88 is preferably provided with a flow restrictor in order to create a siphoning action and increase the flow speed of the washing fluid to the drain.

As best shown in FIG. 4, drain conduit 88 is generally U-shaped and includes a first section 161, a central section 163 and an outlet section 165 which is fluidly connected to a drain line (not shown). In the most preferred form of the invention, central section 163 includes a first portion 169 having a first cross-sectional area, a second portion 170 having a second cross-sectional area, and a third portion 171 having a third cross-sectional area. In further accordance with the most preferred embodiment of the invention, second portion 170 includes a flow restrictor or venturi 173. That is, the second cross-sectional area is less than either the first or third cross-sectional areas of first and third portions 169 and 171 respectively. In this arrangement, the velocity of washing fluid entering third portion 171 is caused to rise sharply through venturi 173, while creating a siphoning action in wash chamber 28. The siphoning action results in a shortened drain operation. In this manner, the decrease in the required time to perform a drain operation results in a corresponding reduction in the time required to perform the overall washing operation.

Based on the above, it should be understood that the present invention provides for a compact and efficient combination or integrated recirculation/drain pump assembly for a drawer-type dishwasher which can be effectively operated without requiring a significant amount of space. In addition, the pump system of the present invention provides for a shortened drain operation. In any case, although described with reference to a preferred embodiment of the invention, it should be readily understood that various changes and/or modifications can be made to the invention without departing from the spirit thereof. For instance, while the pump system is shown to include a single outlet that leads to a single wash arm, the pump system could supply washing fluid to multiple wash arms. In general, the invention is only intended to be limited by the scope of the following claims.

We claim:

1. A dishwasher comprising:

a frame;

a tub slidably mounted in the frame, said tub including front, rear, bottom and opposing side walls that collectively define a wash chamber;

at least one wash arm for directing a flow of washing fluid onto clishware placed in the wash chamber for a washing operation; and a combination recirculation and drain pump system including:

a flow housing provided at a rear portion of the tub, said flow housing including an inlet portion, an outlet portion fluidly leading to the at least one wash arm, a drain port connected to the outlet portion with a valve therebetween, and a pump portion;

a pump provided in the pump portion wherein, during a washing operation, operation of the pump causes the flow housing to receive the flow of washing fluid through the inlet portion and thereafter to expel the flow of washing fluid from the outlet portion to the at least one wash arm; and a drain conduit fluidly connected to the drain port, said drain conduit including a venturi portion wherein, during a drain operation, washing fluid is drawn out from the wash chamber to the inlet portion by operation of the pump and guided downstream of the outlet portion and through the drain port into the drain conduit, with said venturi portion creating a siphoning action that decreases an overall drain time.

2. A dishwasher comprising:

a frame;

a tub slidably mounted in the frame, said tub including front, rear, bottom and opposing side walls that collectively define a wash chamber;

at least one wash arm for directing a flow of washing fluid onto dishware placed in the wash chamber for a washing operation; and a combination recirculation and drain pump system including:

a flow housing provided at a rear portion of the tub, said flow housing including an inlet portion, an outlet portion, a drain port connected through a valve to bypass the outlet portion with a valve therebetween, and a pump portion; and a pump provided in the pump portion wherein, during a washing operation, operation of the pump causes the flow housing to receive the flow of washing fluid through the inlet portion and thereafter to expel the flow of washing fluid from the outlet portion to the at least one wash arm and, during a drain operation, operation of the pump causes the flow housing to receive the flow of washing fluid which is directed downstream of the outlet portion to the drain port.

3. The dishwasher according to claim 2, further comprising: a motor having a drive member mounted to the flow housing.

4. The dishwasher according to claim 3, wherein the pump includes an impeller arranged between the inlet portion and the outlet portion of the flow housing, said impeller being drivingly connected to the drive member.

5. The dishwasher according to claim 4, further comprising: a chopping mechanism mounted adjacent to the impeller in the flow housing.

6. The dishwasher according to claim 5, wherein the chopping mechanism includes an apertured plate and a chopping blade, said chopping blade being driven adjacent the apertured plate by the drive member.

7. The dishwasher according to claim 6, wherein the chopping mechanism includes a spring damper connected to the chopping blade, said spring damper allowing the chopping blade to shift relative to the apertured plate upon encountering a hard soil particle.

8. The dishwasher according to claim 4, further comprising: a plurality of flow straightening fins arranged downstream of both the impeller and the inlet portion, as well as upstream of both the drain port and outlet portion in the flow housing,

9. The dishwasher according to claim 4, wherein the valve is provided at the drain port, said valve being selectively opened to cause the pump to discharge the washing fluid from the wash chamber.

10. The dishwasher according to claim 9, further comprising: a solenoid for operating the valve.

11. The dishwasher according to claim 9, wherein the valve constitutes a one-way valve.

12. The dishwasher according to claim 11, wherein the one-way valve is a flapper valve.

13. The dishwasher according to claim 2, further comprising: another tub slidably mounted in the frame, with the dishwasher constituting a dual drawer dishwasher.

14. The dishwasher according to claim 2, wherein the flow housing constitutes an elongated, substantially cylindrical-shaped housing.

15. The dishwasher according to claim 14, wherein the flow housing extends substantially horizontally across the rear portion of the tub.

16. The dishwasher according to claim 15, wherein the flow housing extends laterally across the rear portion of the tub.

17. A dishwasher comprising:

a frame;

a tub slidably mounted in the frame, said tub including front, rear, bottom and opposing side walls that collectively define a wash chamber;

at least one wash arm for directing a flow of washing fluid onto dishware placed in the wash chamber for a washing operation; and a combination recirculation and drain pump system including:

a flow housing including an inlet portion, an outlet portion fluidly leading to the at least one wash arm, a drain port and a pump portion;

a pump provided in the pump portion; and a drain conduit fluidly connected to the drain port, said drain conduit including a venturi portion wherein, during a drain operation, washing fluid is drawn out from the wash chamber to the inlet portion by operation of the pump and guided downstream of the outlet portion and through the drain port into the drain conduit, with the drain port being connected to the outlet portion with a valve therebetween and said venturi portion creating a siphoning action that decreases an overall drain time.

18. The dishwasher according to claim 17, wherein the valve is provided at the drain port, said valve being selectively opened to allow the pump to discharge the washing fluid from the wash chamber.

19. The dishwasher according to claim 18, further comprising: a solenoid for operating the valve.

20. The dishwasher according to claim 18, wherein the valve constitutes a one-way valve.

21. The dishwasher according to claim 20, wherein the one-way valve is a flapper valve.

22. The dishwasher according to claim 17, wherein the drain conduit is substantially U-shaped having a first section connected to the drain port, a central section and an outlet section.

23. The dishwasher according to claim 22, wherein the central section includes a first portion having a first cross-sectional area, a second portion having a second cross sectional area and a third portion having a third cross-sectional area.

24. The dishwasher according to claim 23, wherein the second cross-sectional area is smaller than the first and third cross-sectional areas, said venturi being constituted by the second portion of the central section.

25. The dishwasher according to claim 17, wherein the flow housing constitutes an elongated, substantially cylindrical-shaped housing.

26. The dishwasher according to claim 17, further comprising: another tub slidably mounted in the frame, with the dishwasher constituting a dual drawer dishwasher.

27. A method of operating a fluid pumping system in a drawer-type dishwasher comprising:

operating a pump, located in a flow housing, in a first rotational direction to direct washing fluid from a sump to an outlet portion of the flow housing leading to at least one wash arm during a recirculation portion of a washing operation;

shifting a valve to open a drain port connected to the outlet portion with the valve therebetween in the flow housing; and operating the pump in the first rotational direction to direct the washing fluid from the sump downstream of the outlet portion and through the drain port to a drain line during a drain portion of the washing operation.

28. The method of claim 27, further comprising: creating a siphoning action, through the use of a venturi in a drain conduit connected to the drain port, during the drain portion of the washing operation.

29. The method of claim 27, further comprising: preventing backflow from the drain line to the flow housing through the valve during the recirculation portion of the washing operation.

* * * * *